US005900854A

United States Patent [19]

Itoh et al.

[11] Patent Number: 5,900,854

[45] Date of Patent: May 4, 1999

[54] DRIVE UNIT OF LIQUID CRYSTAL DISPLAY AND DRIVE METHOD OF LIQUID CRYSTAL DISPLAY

[75] Inventors: Hiroji Itoh, Zama; Naoki Yamada, Yokohama; Junichi Mihara, Sagamihara; Yasuhito Kikuchi, Yokohama, all of Japan

[73] Assignee: International Business Machines Corporation, Armonk, N.Y.

[21] Appl. No.: 08/535,414

[22] Filed: Sep. 28, 1995

[30] Foreign Application Priority Data

Sep. 28, 1994 [JP] Japan ..... 6-233808

[51] Int. Cl.[6] ..... G09G 3/18

[52] U.S. Cl. ..... 345/99; 345/92

[58] Field of Search ..... 345/87, 89, 92, 345/94–96, 204, 99, 208–210; 349/42, 43, 46, 47, 49

[56] References Cited

U.S. PATENT DOCUMENTS 4,651,148 3/1987 Takeda et al. ..... 345/92
4,917,468 4/1990 Malsuhashi et al. ..... 345/87
5,262,881 11/1993 Kuwata et al. ..... 345/94
5,434,599 7/1995 Hirai et al. ..... 345/94
5,481,651 1/1996 Herold ..... 345/94
5,627,457 5/1997 Ishiyama et al. ..... 345/94

*Primary Examiner*—Lun-Yi Lao
*Attorney, Agent, or Firm*—Scully, Scott, Murphy & Presser

[57] ABSTRACT

An image on a liquid crystal is displayed with a constant picture quality, independent of the capacity characteristic variations of the display and the conditions of signals for displaying an image. A gate-timing control circuit 50 of a drive circuit receives input signals J1, J2, and J3 from a system 44. The signals J1 and J2 are prestored in the timing-gate control circuit 50 and contain information for selecting any of a plurality of data, each representing different timing at which a gate line 28 of an LCD 10 is turned on and off. The timing control circuit 50 selects any of the plurality of data according to the signals J1 and J2, generates a gate line control signal YOE based upon the selected data, and outputs it to a gate line driver 30. The gate line driver 30 drives the gate line 28 at timing corresponding to the gate line control signal YOE.

8 Claims, 11 Drawing Sheets

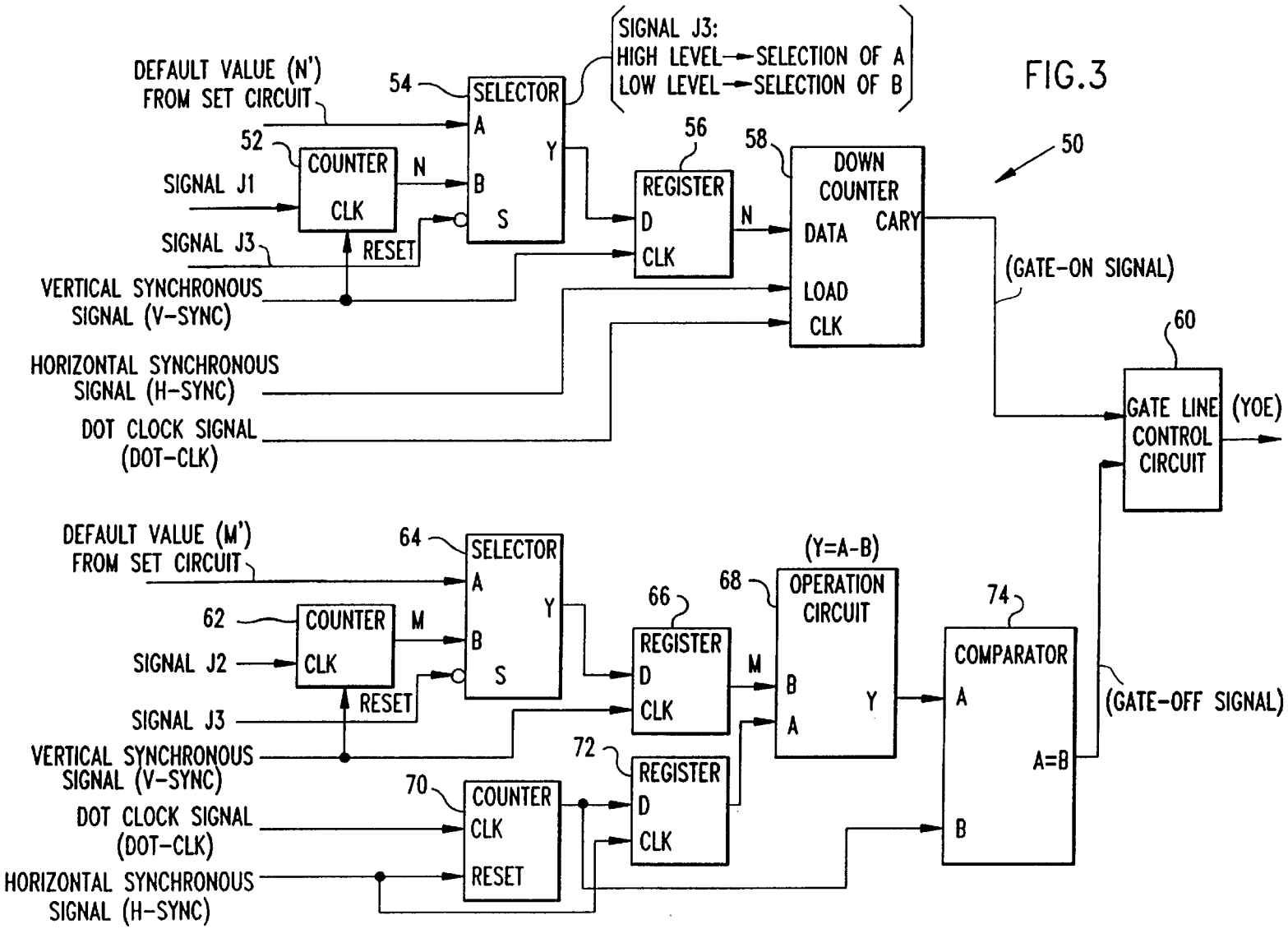
FIG.3
50
SIGNAL J3:
HIGH LEVEL → SELECTION OF A
LOW LEVEL → SELECTION OF B
DEFAULT VALUE (N')
FROM SET CIRCUIT
52
COUNTER
N
CLK
RESET
SIGNAL J1
SIGNAL J3
54
SELECTOR
A
B
S
Y
56
REGISTER
D
CLK
N
58
DOWN COUNTER
DATA
LOAD
CLK
CARY
VERTICAL SYNCHRONOUS SIGNAL (V-SYNC)
HORIZONTAL SYNCHRONOUS SIGNAL (H-SYNC)
DOT CLOCK SIGNAL (DOT-CLK)
(GATE-ON SIGNAL)
60
GATE LINE CONTROL CIRCUIT
(YOE)
(GATE-OFF SIGNAL)
74
COMPARATOR
A
B
A=B
(Y=A-B)
68
OPERATION CIRCUIT
B
A
Y
M
66
REGISTER
D
CLK
72
REGISTER
D
CLK
64
SELECTOR
A
B
S
Y
62
COUNTER
M
CLK
RESET
70
COUNTER
CLK
RESET
DEFAULT VALUE (M')
FROM SET CIRCUIT
SIGNAL J2
SIGNAL J3
VERTICAL SYNCHRONOUS SIGNAL (V-SYNC)
DOT CLOCK SIGNAL (DOT-CLK)
HORIZONTAL SYNCHRONOUS SIGNAL (H-SYNC)

DRIVE UNIT OF LIQUID CRYSTAL DISPLAY AND DRIVE METHOD OF LIQUID CRYSTAL DISPLAY

FIELD OF THE INVENTION

The present invention relates to a drive unit of a liquid crystal display and a drive method of a liquid crystal display, and, more particularly, to a liquid-crystal-display drive method for driving a liquid crystal display provided with a switching element, a pair of transparent electrodes spaced a predetermined distance, and a liquid crystal disposed between the transparent electrodes, and to a liquid-crystal-display drive unit to which the drive method is applicable.

BACKGROUND ART

In information processing systems such as personal computers, a liquid crystal display (hereinafter referred to as a LCD) is so far known as a display for displaying images such as characters and graphics. There are many kinds of LCDs, but in recent years there is extensively employed an active matrix drive LCD using a switching element such as a thin film transistor (TFT) which is capable of reliably controlling a picture cell density and suitable to the display of fast-moving animation and color images. In the LCD of the TFT type, a plurality of pairs of spaced electrodes is provided, and a plurality of TFTs connected with one another are installed on one of the spaced substrate in the form of a matrix. Also, on the transparent substrate there is installed a plurality of gate lines for turning on TFTs for each row and a plurality of data lines for applying a voltage to the liquid crystal through TFT. Also, a transparent common electrode is formed over the entire surface of the other substrate opposed to the one substrate on which the TFTs are installed, and the liquid crystal is interposed between the spaced substrate.

A TFT active-matrix driven drive circuit for driving a LCD displays an image by turning on each of the switching element rows in sequence by applying a voltage to the gate line, and by applying a voltage, which corresponds in magnitude to the degradation of each pixel corresponding to the switching element row turned on, to the liquid crystal through each data line. During the time the switching element is turned on, the light transmittance of the liquid crystal changes according to the magnitude of the voltage applied through the data line, an electric charge is accumulated in the capacitor of the liquid crystal, and, after the switching element has been turned off, the state that the light transmittance was changed is held by the accumulated charge.

Also, the gate line contains a resistor and a capacitor, and, on the one hand, it takes time between the time that the drive circuit applies a voltage to the gate line and the time that the voltage level of the gate line becomes large enough for turning the switching element. On the other hand, the light transmittance of the liquid crystal changes according to the magnitude of the charge stored in the capacitor of the liquid crystal, but the magnitude of this charge depends upon the period during which the switching element is turned on, and the capacitance part itself of the liquid crystal changes according to the space between a pair of substrates. Therefore, the application of voltage to the gate line and the timing (hereinafter referred to as gate timing) that the application of voltage to the gate line is stopped are determined so that a constant picture quality can be obtained, taking into consideration the capacitor of the gate line of a LCD to be driven and the capacity of the liquid crystal. The drive circuit is designed so that the gate line is turned on and off at the determined gate timing.

However, on the one hand, for the capacity of the gate line of the LCD or the liquid crystal capacity, there are variations for each lot because of the production errors of the LCD. On the other hand, since the drive circuit turns the gate line on and off at the gate timing determined when designed, a disturbance in the displayed image occurs according to characteristics such as the capacity of the gate line of the LCD or the liquid crystal capacity, and therefore there was the problem that a constant picture quality could not be obtained.

Also, when an information processing system such as a personal computer displays an image on a LCD unit comprising a LCD and a drive circuit, the information processing system transmits to the drive circuit of the LCD unit an image data signal indicative of the degradation of each pixel of the image to be displayed, a horizontal synchronous signal, a vertical synchronous signal, and a dot clock signal for fetching data for each pixel from the image data signal. Also, the drive circuit decides the incoming of on-off timing of a predetermined gate line by counting the dot clock signals with the pulse timing of the horizontal synchronous signal as a reference.

However, the frequency of the dot clock signal output by the information processing system is different, depending on the kind of information processing system. Since the drive circuit is designed on the assumption that a dot clock signal of a predetermined constant frequency is input, the on-off timing of the gate line will change if the frequency of the dot clock signal changes. As a result, there was the problem that there could occur disturbance in the displayed image. Also, in order to prevent such disturbance in the displayed image, it was necessary to limit the kind of information processing system that could be connected to the LCD.

Further, in some of the information processing systems, the frequency of the dot clock signal can be changed by software. In such information processing systems, there is the possibility that the frequency of the dot clock signal is changed at an arbitrary timing, depending upon the software that is executed by the information processing system. Therefore, an image cannot be displayed with a constant picture quality with respect to such software.

SUMMARY OF THE INVENTION

In view of the above-described facts, it is an object of the present invention to provide a drive method for a liquid crystal display and a drive unit for a liquid crystal display which are capable of displaying an image on a liquid crystal display with a constant picture quality, independent of the various characteristic variations of liquid crystal displays and the signal conditions for displaying an image on a liquid crystal display.

To achieve the above object, a drive unit for a liquid crystal display unit according to the invention comprises a drive unit for driving a liquid crystal display that has a switching element, a transparent electrode pair spaced a predetermined distance apart, and liquid crystal interposed between the transparent electrodes. The drive unit comprises a holding means for holding, when at least either on-timing at which said switching element is turned on or off-timing at which said switching element is turned off is specified within a predetermined cycle, information representative of the specified at least either on-timing or off-timing; and a drive means for turning on said switching element at a predetermined timing according to information indicative of at least either latest on-timing or off-timing stored in said holding means, repeating at intervals of a predetermined cycle that said switching element is turned off at said predetermined timing, after a voltage has been applied to said liquid crystal through said transparent electrode pair, and driving said liquid crystal display.

The driving means is provided with a decision means for deciding an incoming of at least either said on-timing or said off-timing that latest information held in said holding means represents, by counting the number of pulses of a clock signal as a reference of said predetermined cycle, and said switching element is turned on and off when said incoming of at least either said on-timing or said off-timing is decided by said decision means.

The invention further comprises a first storage means having prestored therein plural kinds of data which represent plural kinds of timings different from each other as the on-timing and off-timing of said switching element with said number of pulses of said clock signal, and, if information for selecting any of said plural kinds of data prestored in said first storage means is input and then said at least either on-timing or off-timing is specified, said holding means selects any of said plural data according to said input information and holds said selected data as information representative of the specified at least either on-timing or off-timing, and said decision means decides the incoming of said specified timing by counting said number of pulses of said clock signal according to the latest data held in said holding means.

The invention further comprises a second storage means in which each of said plural kinds of data, which represents with the said number of pulses of the clock signal at least either suitable on-timing or off-timing of said switching element that changes according to the frequency of said clock signal, is prestored in correspondence with said frequency of said clock signal; a detection means for detecting said frequency of said clock signal; and a specification means for selecting data corresponding to the frequency of the clock signal detected by said detection means from said plural kinds of data stored in said second storage means and specifying said at least either on-timing or off-timing by the selected data.

The drive method further comprises, driving a liquid crystal display that has a switching element, a transparent electrode pair spaced a predetermined distance apart, and liquid crystal interposed between the transparent electrodes. The drive method comprises the steps of, when at least either on-timing at which said switching element is turned on or off-timing at which said switching element is turned off is specified within a predetermined cycle, holding information representative of the specified at least either on-timing or off-timing; and turning on said switching element at predetermined timing according to information indicative of at least either latest on-timing or off-timing stored in said holding means, repeating at intervals of a predetermined cycle that said switching element is turned off at said predetermined timing, after a voltage has been applied to said liquid crystal through said transparent electrode pair, and driving said liquid crystal display.

The invention is characterized in that, an incoming of at least either said on-timing or said off-timing that latest information held in said holding means represents is decided by counting the number of pulses of a clock signal as a reference of said predetermined cycle, and said switching element is turned on and off when said incoming of at least either said on-timing or said off-timing is decided.

The invention further comprises the steps of prestoring plural kinds of data which represent plural kinds of timings different from each other as the on-timing and off-timing of said switching element with said number of pulses of said clock signal; if information for selecting any of said plural kinds of data prestored in said first storage means is input and then said at least either on-timing or off-timing is specified, selecting any of said plural data according to said input information and holding said selected data as information representative of the specified at least either on-timing or off-timing; and deciding the incoming of said specified timing by counting said number of pulses of said clock signal according to the latest data held in said holding means.

The invention comprises the steps of prestoring each of said plural kinds of data, which represents with the said number of pulses of the clock signal at least either suitable on-timing or off-timing of said switching element that changes according to the frequency of said clock signal, in correspondence with said frequency of said clock signal; detecting said frequency of said clock signal; and selecting data corresponding to the frequency of the clock signal detected by said detection means from said plural kinds of data stored in said second storage means, and specifying said at least either on-timing or off-timing by the selected data.

At least either on-timing at which said switching element is turned on or off-timing at which said switching element is turned off is specified within a predetermined cycle, information representative of the specified at least either on-timing or off-timing is held by said holding means. Also, according to information indicative of at least either latest on-timing or off-timing stored in said holding means, a drive means turns on said switching element at predetermined timing, after a voltage has been applied to said liquid crystal through said transparent electrode pair, said switching element is turned off at said predetermined timing, repeating at intervals of a predetermined cycle, and drives said liquid crystal display.

Note that the specification of at least either on-timing or off-timing may be performed, for example, by an external system connected to the drive unit of the present invention. As will be described later, the timing may be automatically specified inside the drive unit. Also, while an information processing system such as a personal computer, a workstation, or a word processor for outputting a signal for displaying an image on a liquid crystal display can be employed as the above-described external system, the invention is not limited to this. For example, an inspection instrument connected for performing an inspection in the inspection process of the liquid crystal display may be used.

In addition, the above-described information processing system can specify at least either on-timing or off-timing, according to the conditions (e.g., frequency of the dot clock signal) of signals for displaying an image, so that the switching element can be turned on and off at suitable timing, and the above-described inspection equipment can specify at least either on-timing or off-timing, according to the various characteristics (e.g., liquid crystal capacity) inspected in the inspection process, so that the switching element can be turned on and off at suitable timing.

As described above, if at least either on-timing or off-timing is specified, information representative of the specified timing will be held and at least either on-timing or off-timing will be changed. Therefore, even if at least either on-timing or off-timing is changed according to various characteristics, such as the magnitude of the liquid crystal capacity changing according to the space between the transparent electrodes of the liquid crystal display and the magnitude of the capacitor of the signal line for turning on and off the switching element, and the signal conditions of the liquid crystal display are changed, the timing would be changed to an appropriate timing corresponding to the signal conditions in which the on-timing and the off-timing have been changed. Therefore, independent of the various characteristic variations of the liquid crystal display and the conditions of signals for displaying an image on a liquid crystal display, it becomes possible to display an image on a liquid crystal display with a constant picture quality.

Incidentally, when, as information representative of at least either on-timing or off-timing, the holding means, for example, holds information representative of a time interval between reference timing (e.g., start time of a predetermined cycle) and on-timing or off-timing, the incoming of the on-timing or off-timing can be determined by measuring the time that elapsed from the incoming of the reference timing. However, in order to determine the incoming of the on-timing or off-timing by measurement an elapsed time, the construction become complicated because it requires a time measurement circuit and a timer circuit, and it is difficult to accurately decide the incoming of the on-timing and the off-timing, because the above-described predetermined cycle is generally very short.

For this reason, it is preferable that the incoming of at least either said on-timing or said off-timing, which latest information held in said holding means represents, be decided by counting the number of pulses of a clock signal as a reference of said predetermined cycle. This can be realized by holding in the holding means the information representative of on-timing or off-timing with the number of pulses of the clock signal. Note that, as the above-described clock signal, there can be employed a dot clock signal, or a signal generated, for example, from a horizontal synchronous signal or vertical synchronous signal. Therefore, the drive unit of the liquid crystal display according to the present invention becomes structurally simple and also the incoming of on-timing and off-timing can be accurately decided.

In the invention, holding in the holding means the information representative of on-timing or off-timing with the number of pulses of the clock signal can be realized, for example, by inputting information representative of on-timing or off-timing with the number of pulses of the clock signal and by specifying at least either on-timing or off-timing. However, the timing depends also on the frequency of the clock signal, but even if the on-timing or off-timing is changed by an amount of change corresponding to one pulse, a visible change would not occur in the picture quality of the image displayed on a liquid crystal display. It is therefore preferable that the on-timing or off-timing be changed in the unit of an amount of change corresponding to several pulses.

Thus, when the on-timing or off-timing is changed in the unit of an amount of change corresponding to several pulses, an amount of information (number of bits for binary data) for representing on-timing or off-timing with the number of pulses is clearly increased as described above, as compared to an amount of information representing the number of kinds of on-timing or off-timing. Therefore, if the on-timing or off-timing, for example, is indicated by an external equipment such as a personal computer, there will be the possibility that the interface becomes complicated such that the number of signal lines for transmitting that indication is increased.

For this reason, there is provided a first storage means having prestored therein plural kinds of data which represent plural kinds of timings different from each other as the on-timing and off-timing of said switching element with said number of pulses of said clock signal, and at least either on-timing or off-timing is preferable to be specified by inputting information for selecting any of said plural kinds of data prestored in said first storage means. In such case, the holding means can select any of plural data according to said input information and hold said selected data, and decision means can decide the incoming of the specified timing by counting said number of pulses of said clock signal according to the latest data held in said holding means.

As described above, an amount of information for indicating at least either on-timing or off-timing becomes small. Therefore, even if the on-timing or off-timing, for example, were indicated by external equipment such as a personal computer, the interface can be simplified such that the number of signal lines for transmitting that indication can be reduced.

Incidentally, on the one hand, when the on-timing or off-timing is specified by external equipment, it is necessary to provide an additional interface through which the on-timing or off-timing is specified by an external equipment. On the other hand, if a second storage means in which each of said plural kinds of data, which represents with the said number of pulses of the clock signal at least either suitable on-timing or off-timing of said switching element that changes according to the frequency of said clock signal, is prestored in correspondence with said frequency of said clock signal, a detection means for detecting said frequency of said clock signal, and a specification means for selecting data corresponding to the frequency of the clock signal detected by said detection means from said plural kinds of data stored in said second storage means and specifying said at least either on-timing or off-timing by the selected data are further provided, at least on-off timing of the switching element can be automatically changed according to a change in the frequency of the clock signal to appropriate timing, and there is no need for providing an additional interface in the external equipment.

In the invention, when at least either on-timing at which said switching element is turned on or off-timing at which said switching element is turned off is specified, information representative of the specified at least either on-timing or off-timing is hold. The switching element is turned on at predetermined timing according to information indicative of at least either latest on-timing or off-timing stored in said holding means, after a voltage has been applied to said liquid crystal through said transparent electrode pair, said switching element is turned off at said predetermined timing, and it is repeated, at intervals of a predetermined cycle. Therefore, independent of the various characteristic variations of the liquid crystal display and the conditions of signals for displaying an image on a liquid crystal display, it becomes possible to display an image on a liquid crystal display with a constant picture quality.

An incoming of at least either said on-timing or said off-timing that latest information held in said holding means represents is decided by counting the number of pulses of a clock signal as a reference of said predetermined cycle, and said switching element is turned on and off when said incoming at least either said on-timing or said off-timing is decided. Therefore, the incoming on-timing or off-timing can be accurately decided.

The invention further comprises the steps of prestoring plural kinds of data which represent plural kinds of timings different from each other as the on-timing and off-timing of said switching element with said number of pulses of said clock signal; if information for selecting any of said plural kinds of data prestored in said first storage means is input and then said at least either on-timing or off-timing is specified, selecting any of said plural data according to said input information and holding said selected data and deciding the incoming of said specified timing by counting said number of pulses of said clock signal according to the latest data held in said holding means. Therefore, the amount of information for indicating at least either on-timing or off-timing can be reduced.

The invention comprises the steps of prestoring each of said plural kinds of data, which represents with the said number of pulses of the clock signal at least either suitable on-timing or off-timing of said switching element that changes according to the frequency of said clock signal, in correspondence with said frequency of said clock signal; detecting said frequency of said clock signal; and selecting data corresponding to the frequency of the clock signal detected by said detection means from said plural kinds of data stored in said second storage means, and specifying said at least either on-timing or off-timing by the selected data. Therefore, an appropriate change of at least either on-timing or off-timing can be automatically performed according to a change in the frequency of the clock signal without depending upon additional external equipment.

BRIEF DESCRIPTION OF THE DRAWINGS

FIG. 3 is a block diagram showing the gate-timing control circuit in FIG. 1;

DETAILED DESCRIPTION OF THE PREFERRED EMBODIMENTS

An embodiment of the present invention will hereinafter be described in detail with reference to the drawings. The present invention is described in conjunction with numerical values not interfering with the invention but it is limited to the numerical values described below.

Figure 1:
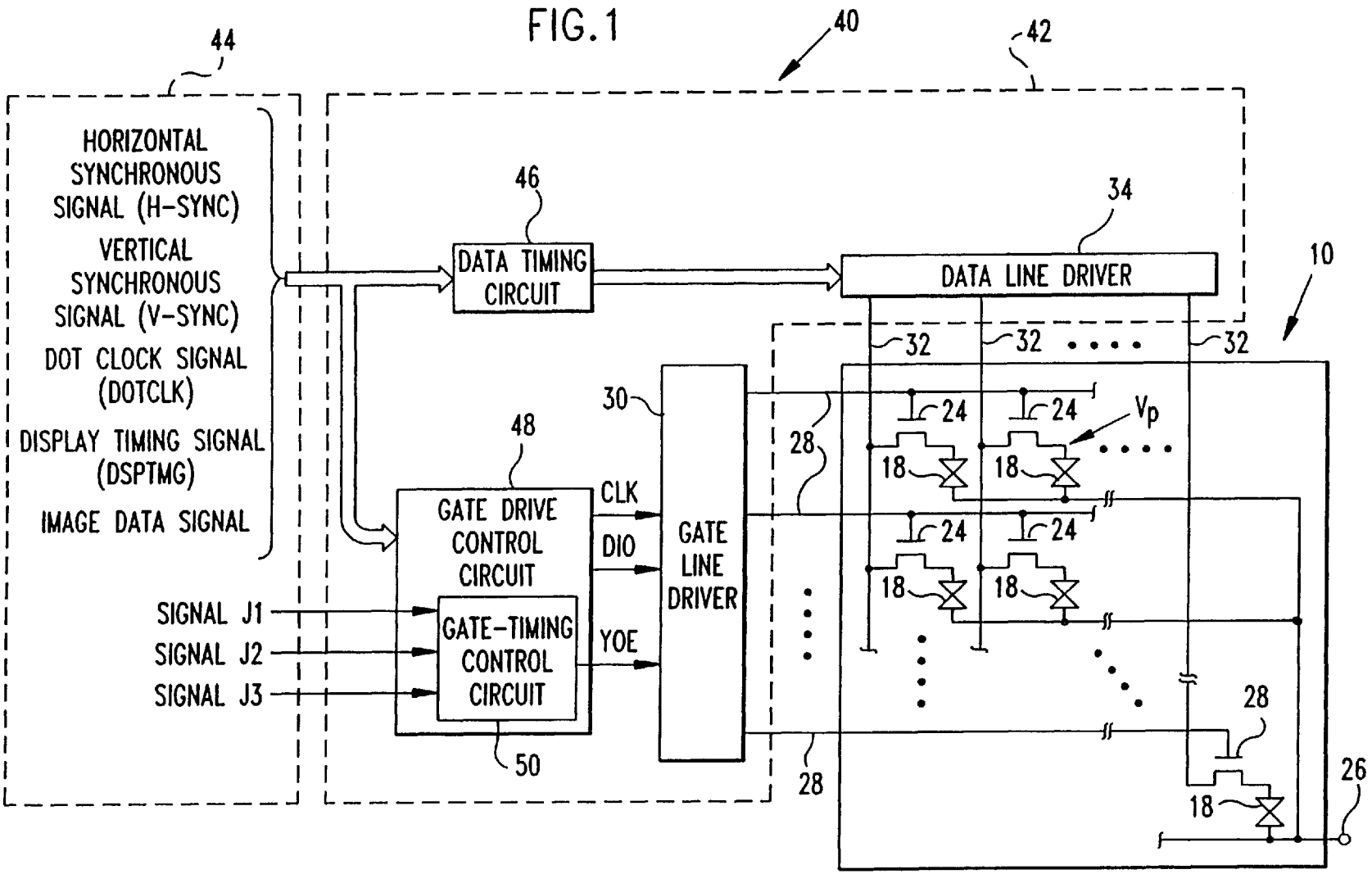
FIG. 1 is a block diagram showing an LCD and a drive circuit of a first embodiment of the present invention.
Figure 2:
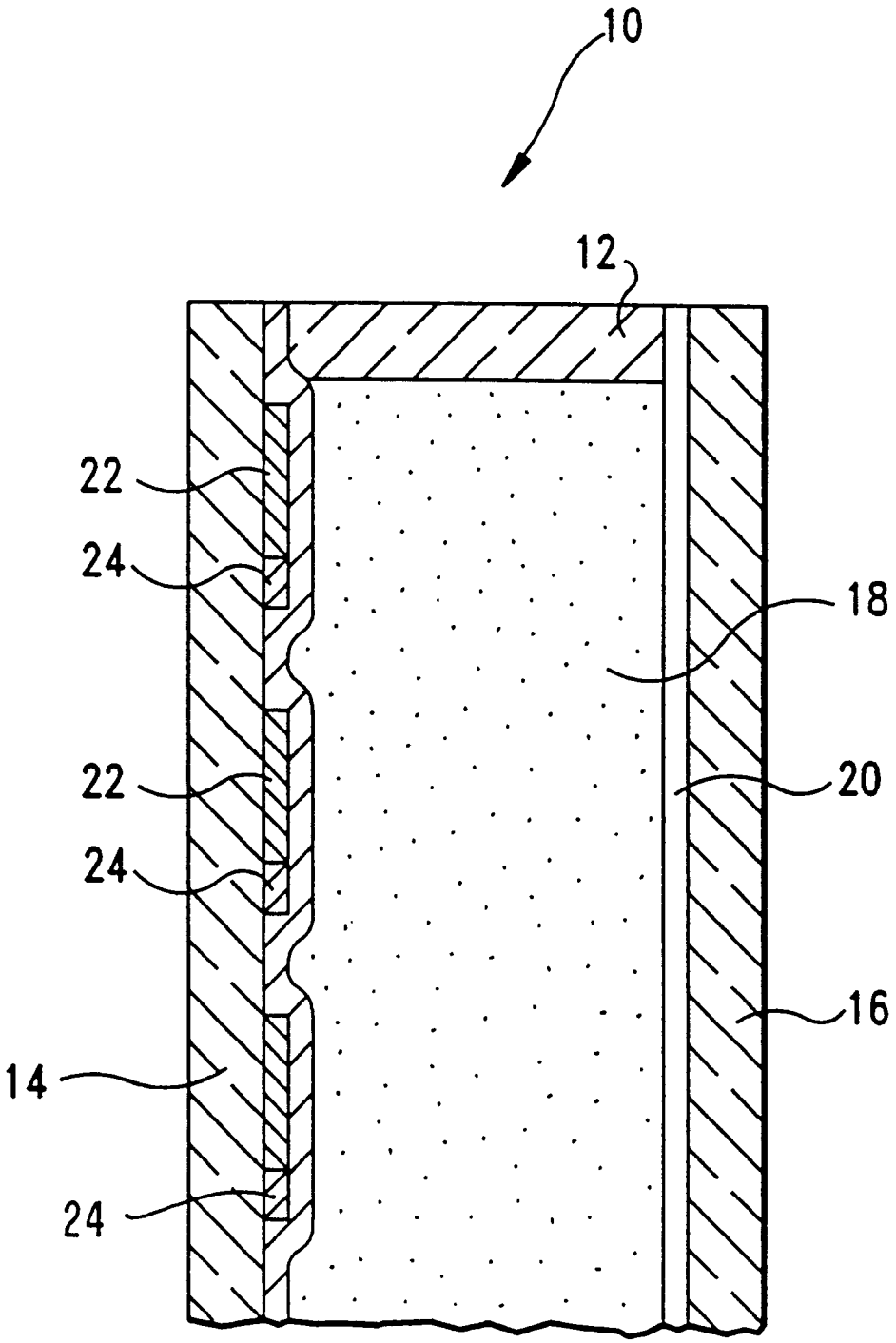
FIG. 2 is a part sectional view of the LCD.

FIG. 1 shows an LCD unit 40 according to a first embodiment of the present invention. The LCD unit 40 is provided with a drive circuit 42 as a drive unit for a liquid crystal display according to the present invention, and an LCD 10 as an LCD. As shown in FIG. 2, the LCD 10 comprises a pair of transparent substrates 14 and 16 spaced a predetermined distance by a spacer 12, and a liquid crystal 18 enclosed between the transparent substrates 14 and 16. Over the entire of the surface where the transparent substrate 16 contacts the crystal liquid 18, there is formed an electrode 20. Also, over the entire of the surface where the transparent substrate 14 contacts the crystal liquid 18, there are formed TFTs 24 in the form of a matrix (FIG. 2). A plurality of electrodes 22 is provided in correspondence with the TFTs 24.

In FIG. 1 the circuitry of the LCD 10 is made simple. Although the details of the circuitry are not shown, the above-described electrodes 22 are connected to the TFTs 24, and the liquid crystal 18 is interposed between the electrodes 22 and the electrode 20 (in FIG. 2, the electrode 20 is shown as a wire extending from one end of each of a plurality of the liquid crystals 18 shown in FIG. 2 to a common terminal 26). Note that each of the liquid crystals 18 shown in large numbers in FIG. 2 corresponds to one pixel of an image that will be shown in the LCD 10, and constitutes a display cell, together with the TFT 24 and the electrodes 22, 20. Also, in this embodiment, the common terminal 26 connected with the electrode 20 is connected to ground and the potential of the electrode 20 is constant (ground level).

In the LCD 10, on the one hand, there is provided a plurality of gate lines 28 extending along predetermined directions to the side of the transparent substrate 14, and the gate of each of the TFTs 24 is connected to any one of the gate lines 28. Each of the gate lines 28 is connected to a gate line driver 30 of a drive circuit 42. Also, on the side of the transparent substrate 14 of the LCD 10, there is provided a plurality of data lines 32 extending along directions crossing the gate lines 28, and the drain of each of the TFTs 24 is connected to any one of the data lines 32. Each of the data lines 32 is connected to a data line driver 34 of the drive circuit 42.

On the other hand, the drive circuit 42 is connected to a system 44 constituted by an information processing system such as a work station. The drive circuit 42 is provided with a data timing circuit 46 and a gate drive control circuit 48. To the data timing circuit 46 and the gate drive control circuit 48, there are input a horizontal synchronous signal, a vertical synchronous signal, a dot clock signal, and a display timing signal, which were output by the system 44. Also, to the data timing circuit 46 there is also input an image data signal indicative of an image that is to be displayed on the LCD 10.

The image signal is a signal in which data indicative of a gradation of each of the pixels of an image to be displayed is serially superimposed at intervals of predetermined time in synchronization with the horizontal and vertical synchronous signals. The above-described dot clock signal is a clock signal having a frequency (i.e., about 18 MHz to 32 MHz) synchronized with the data of each of the pixels superimposed in the image data signal. In the data timing circuit 46, the data of each pixel is fetched from the image data signal, based on the dot clock signal.

Also, the display timing signal is a signal which is at a high level during an effective period in which, in one cycle of the horizontal synchronous signal, the pixel data is superimposed in the image data signal, and which is a low level during a period (a so-called blanking period) other than the effective period. The data timing circuit 46 fetches data for each pixel from the image data signal only during the effective period in which the display timing signal is at a high level. The data timing circuit 46 outputs in parallel the data for each pixel fetched as described above to the data line drive 34 for every item of data corresponding to a row of pixels.

In addition to the above-described image data, the horizontal synchronous signal is input from the data timing circuit 46 to the data line driver 34. Based on the data indicative of a gradation of each pixel constituting the input row of pixels, on the one hand, the data line driver 34 supplies a voltage corresponding to the gradation of each pixel to the data line 32 corresponding to each pixel at a timing synchronized with the horizontal synchronous signal.

Figure 4:
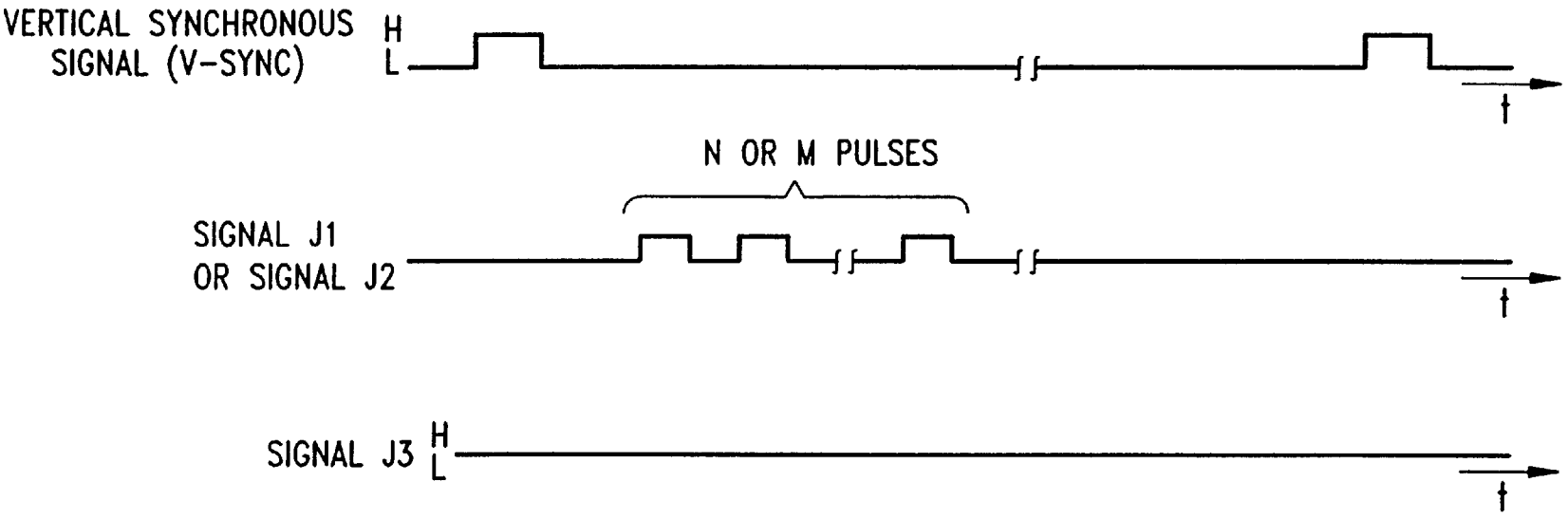
FIG. 4 is a timing chart showing a vertical synchronous signal, and signals J1, J2, and J3 which are input to the gate-timing control circuit by the system in FIG. 1.

On the other hand, the gate driver control circuit 48 is provided with a gate-timing control circuit 50. The gate-timing control circuit 50 is connected to the system 44 so that signals J1, J2, and J3 can be input from the system 44. These signals are a signal for the system 44 to instruct the gate timing of the LCD 10. As shown in FIG. 4, the signal J1 is a signal in which N pulses (in this embodiment N is any value between 0 and 45) always occur during each cycle of the vertical synchronous signal, and the signal J2 is a signal in which M pulses (in this embodiment M is any value between 0 and 7) always occur during each cycle of the vertical synchronous signal.

As will be described later, N is data for specifying the timing (on-timing) at which a gate line voltage is applied to the gate line 28 and M is data for specifying the timing (off-timing) at which application of a gate line voltage to the gate line 28 is stopped. The system 44 determines the values of N and M in accordance with the optimum on-timing and off-timing corresponding to the gate line 28 and outputs the signals J1 and J2 corresponding to the determined values of N and M. Also, the signal J3 is made low (active) during the time the signals J1 and J2 are output from the system 44.

As also shown in FIG. 3, the gate-timing control circuit 50 is provided with a counter 52 to which the signal J1 is input. To the counter 52 there is input the vertical synchronous signal as a reset signal. The counter 52 therefore counts the number of pulses of the signal J1 in each cycle of the vertical synchronous signal. The output terminal of the counter 52 is connected to two input terminals B of a selector 54 so that the count value can be output as data N to the selector 54. The input terminal A of the selector 54 is connected to a default value set circuit (not shown). The default value set circuit outputs a preset default value N' to the selector 54. Also, the signal J3 is input to the select signal input terminal S of the selector 54.

If the signal J3 input through the select signal input terminal S is high, the selector 54 will select the default value N' input through the input terminal A and, if the signal J3 is low, the selector 54 will select the data N input through the input terminal B. The output terminal Y of the selector 54 is connected to the data input terminal D of a register 56. To the clock signal input terminal CLK of the register 56 there is input the vertical synchronous signal. Each time a pulse is input as the vertical synchronous signal, the register 56 fetches data Y (default value N' or data N selected by the selector 54) from the selector 54. As shown in the following Table 1, the register 56 stores therein a table showing the correspondence of the value of the fetched data Y with the count number $N_o$ of the pulses of the dot clock signal.

TABLE 1

| Data Y | Count Number $N_o$ | Count Time ($\mu$s) |
|---|---|---|
| 00 | 0 | 0 |
| 01 | 16 | 0.6 |
| 02 | 32 | 1.2 |
| 03 | 48 | 1.9 |
| 04 | 64 | 2.5 |
| 05 | 80 | 3.1 |
| 06 | 132 | 3.8 |
| : | : | : |
| 10 | 160 | 6.3 |
| : | : | : |
| 45 | 720 | 28.6 |

For reference, the numerical values shown as "Count Time" in Table 1 indicate as an example the time needed for the dot clock signal of frequency 25.175 MHz to reach the count number $N_o$. Only the data Y and the count number $N_o$ in Table 1 are stored in the register 56. The data output terminal of the register 56 is connected to the data input terminal DATA of a down counter 58, and the count number $N_o$ corresponding to the value of the fetched data Y is output to the down counter 58. Thus, the register 56 corresponds to the hold means and the first storage means of the present invention.

The horizontal synchronous signal and the dot clock signal are input to the load clock signal LOAD terminal and the clock signal input terminal CLK of the down counter 58, respectively. Each time the pulse of the horizontal synchronous signal is input as a load signal, the down counter 58 fetches data held in the register 56 and repeatedly decrements the count number $N_o$ fetched at the timing synchronized with the pulse of the dot clock signal. If data goes to 0, the down counter 58 outputs a carry (gate-on signal) from the carry signal output terminal CARY thereof. Thus, the down counter 58 corresponds to the decision means of the present invention. The carry signal output terminal CARY of the down counter 58 is connected to a gate line control signal output circuit 60.

Figure 5:
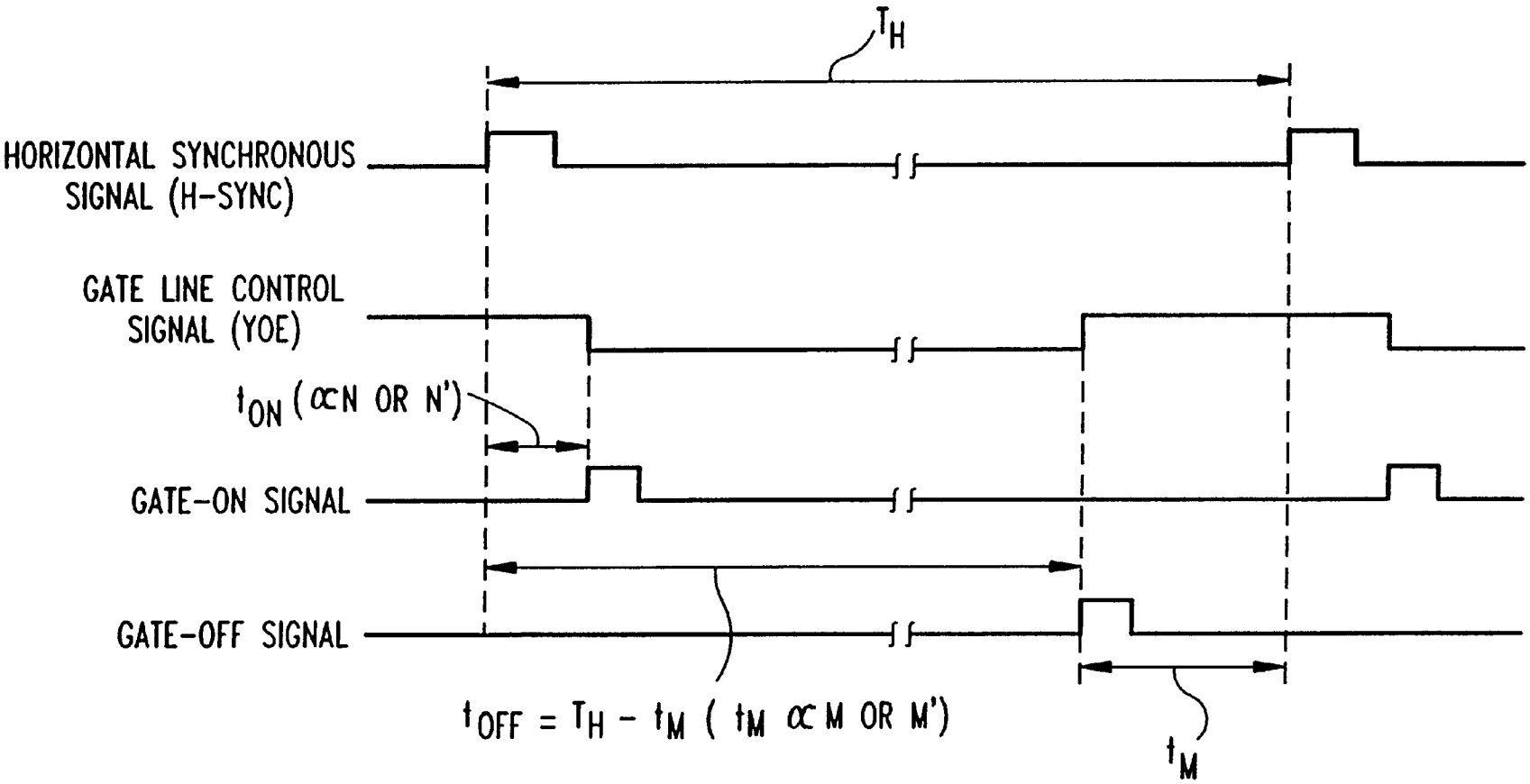
FIG. 5 is a timing chart showing a horizontal synchronous signal, a gate-on signal, a gate-off signal, and a gate line control signal.

From the foregoing and as also shown in FIG. 5, if the accumulated value of the pulses of the dot clock signal from the rise of the pulse of the horizontal synchronous signal reaches the count number $N_o$, i.e., if there elapses the time (in FIG. 5 $t_{ON}$) of one cycle of the dot clock signal multiplied by the count number N, the gate-on signal will go to a high level for a certain period of time.

Also, the signal J2 is input to the counter 62. The counter 62, a selector 64, and a register 66 are connected in the same way as the counter 52, the selector 54, and the register 56, and similar signals are input. However, the count value M is input from the counter 62 to the input terminal B of the selector 64, and a default value M' is input from a default value set circuit (not shown) to the input terminal A of the selector 64. As shown in the following Table 2, the register 66 stores therein a table showing the correspondence of the value of the data Y fetched from the selector 64 with the count number $M_o$ of the dot clock signal.

TABLE 2

| Data Y | Count Number $M_o$ | Count Time ($\mu$s) |
|---|---|---|
| 00 | 64 | 2.5 |
| 01 | 60 | 2.4 |
| 02 | 56 | 2.2 |
| 03 | 52 | 2.1 |
| 04 | 48 | 1.9 |
| 05 | 44 | 1.7 |
| 06 | 40 | 1.6 |
| 07 | 36 | 1.4 |

For the numerical values shown as "Count Time" in Table 2, there is also shown the time needed for the dot clock signal of frequency 25.175 MHz to reach the count number $M_o$, for reference. Only the data Y and the count number $M_o$ in Table 2 are stored in the register 66. The output terminal of the register 66 is connected to the input terminal B of a subtraction circuit 68, and the count number $M_o$ corresponding to the value of the fetched data Y is output to the subtraction circuit 68. The register 66 also corresponds to the hold means and the first storage means of the present invention.

Also, the timing-gate control circuit 50 is provided with a counter 70 to which the dot clock signal is input as a clock signal and the horizontal synchronous signal is input as a reset signal. The counter 70 therefore counts the number of pulses of the dot clock signal which occur during one cycle of the horizontal synchronous signal. The data output terminal of the counter 70 is connected to the data input terminals D of a register 72. The horizontal synchronous signal is input to the clock signal input terminal of the register 72, and the number of pulses of the dot clock signal during one cycle of the horizontal synchronous signal which were counted by the counter 70 is held in the register 72. The data output terminal of the register 72 is connected to the input terminal A of the subtraction circuit 68.

The subtraction circuit 68 is connected to the data input terminal A of a comparator 74 and subtracts the count number $M_o$ input through the input terminal B from the number of pulses of the dot clock signal during one cycle of the horizontal synchronous signal input through the input terminal A. The result of the subtraction is output to the comparator 74. Also, to the input terminal B of the comparator 74 there is input the value counted by the counter 70. The comparator 74 compares the subtraction result input from the subtraction circuit 68 with the value counted by the counter 70 (the count value is incremented sequentially by the count operation of the counter 70) and, when both are consistent with each other, outputs a pulse signal (gate-off signal). The comparator 74 also corresponds to the decision means of the present invention. The signal output terminal of the comparator 74 is connected to the gate line control signal output circuit 60.

From the foregoing and as also shown in FIG. 5, if the accumulated value of the pulses of the dot clock signal from the rise of the pulse of the horizontal synchronous signal reaches a value obtained by subtracting the count number $M_o$ from the number of the pulses of the horizontal synchronous signal of one cycle period of the horizontal synchronous signal, i.e., if there elapses the time (in FIG. 5 $t_{OFF}$) obtained by subtracting from the one cycle $T_H$ of the horizontal synchronous signal the time $t_M$ of one cycle of the dot clock signal multiplied by the count number $M_o$, the gate-off signal will go to a high level for a certain period of time.

The gate line control signal output circuit 60 outputs a gate line control signal (YOE). The gate line control signal is made low (active) when the gate-on signal is high, and made high when the gate-off signal is high (FIG. 5). This gate line control signal (YOE) is input to the gate line driver 30, as also shown in FIG. 1.

In addition to the above-described gate-timing control circuit 50, the gate drive control circuit 48 is provided with a circuit (not shown) for outputting to the gate line driver 30 an internal clock signal CLK of predetermined frequency and a signal DIO synchronized with the vertical synchronous signal that goes active when display of an image by the LCD 10 is started, and also with the above-described default value set circuit.

If the signal DIO goes active and the start of display of an image is instructed, the gate line driver 30 will apply to a first row of gate lines 28 of a plurality of gate lines 28 a voltage for turning on the TFTs 24 connected to the first row of gate lines 28, during the time the gate line control signal input from the gate-timing control circuit 50 is active (low level), and the gate lines 28 to which a voltage is applied at the same timing will hereinafter be switched in sequence.

As will be seen from the foregoing, N and M which are specified by the signals J1 and J2 are information for selecting any one of a plurality of kinds of data stored in each of the registers 56 and 66. Also, the down counter 58 of the gate-timing control circuit 50, the comparator 74, the gate line control signal output circuit 60, and the gate line driver 30 correspond to drive means of the present invention.

The operation of the first embodiment of the present invention will next be described. When an image is displayed on the LCD 10, the horizontal synchronous signal, the vertical synchronous signal, the dot clock signal, the display timing signal, and the image data signal are output from the system 44 to the drive circuit 42. The data indicative of the gradations of pixels is input from the data timing circuit 46 to the data line driver 34 in blocks of one row of pixels. As also shown as a data line voltage $V_{data}$ in FIG. 6, the supply of a voltage corresponding to the gradation of each pixel to the data line 32 corresponding to each pixel is started after a constant period of time $t_o$ (e.g., 3.4 $\mu$sec) from the rise of the pulse of the horizontal synchronous signal.

Figure 6:
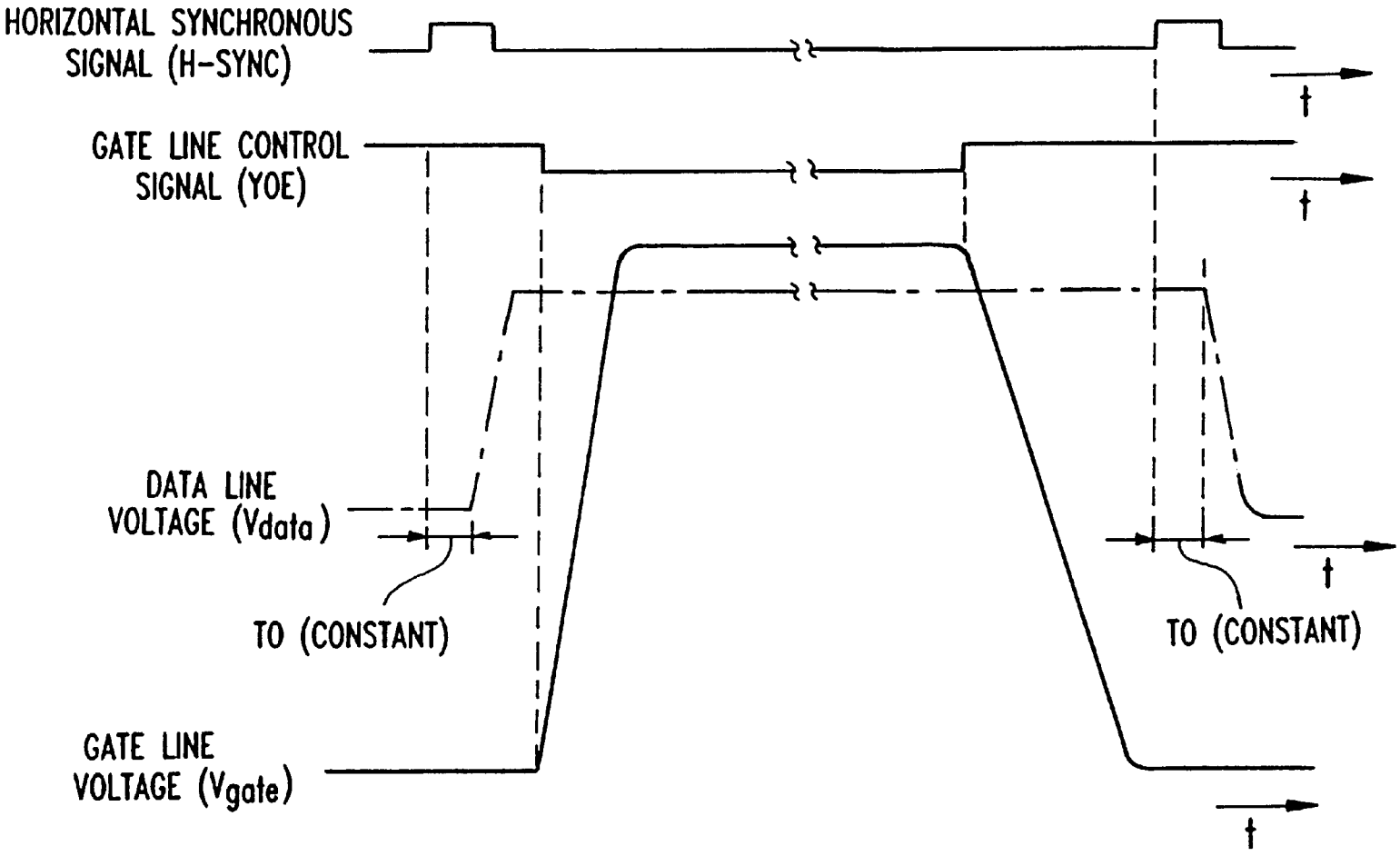
FIG. 6 is a timing chart showing the horizontal synchronous signal, a gate line control signal, a gate line voltage, and a data line voltage.

During this, on the one hand, data corresponding to the next row of pixels is input to the data line driver 34. After a constant period of time $t_o$ from the rise of the pulse of the horizontal synchronous signal, a voltage to be supplied to each data line 32 is switched to a voltage corresponding to the gradation of which the next input row of pixels is indicative. Note that, since FIG. 6 is a timing chart showing the relationship of the data line voltage to the gate line voltage for a particular display cell, the data line voltage $V_{data}$ is shown to be decreased after a constant period of time $t_o$ from the rise of the pulse of the next cycle, for convenience. The voltages corresponding to the gradation of each row of pixels are supplied in sequence to the data line 32 by repeating the above-described processing.

If, on the other hand, the signal J3 input by the system 44 is high, the selectors 52 and 62 of the gate-timing control circuit 50 select the default values N' and M' input by the default value set circuit. As a result, the gate-timing control circuit 50 outputs the gate line control signal which goes to a low level at the timing correspondent to the count number $N_o$ corresponding to the default value N' and a high level at the timing correspondent to the count number $M_o$ corresponding to the default value M'.

As described above, during the time the gate line control signal is at a low level, the gate line driver 30 applies to one gate line 28 of a plurality of the gate lines 28 a voltage for turning on the TFTs 24 connected to that gate lines 28. As a result, the gate line voltage $V_{gate}$ rises at a certain gradient to a certain level because of the capacitor in the gate line 28, as shown in FIG. 6, so the plural TFTs 24 connected to that gate line 28 are turned on. Since, at this time, the data line voltage $V_{data}$ has been applied to the data line 32, as shown in FIG. 6, the data line voltage $V_{data}$ will be applied between the electrodes 22 and 20 if the TFTs 24 are turned on. As result, the light transmittance of the liquid crystal 18 disposed between the electrodes 22 and 20 changes according to the magnitude of $V_{data}$, and a charge is accumulated in the capacitor of the liquid crystal 18.

Also, if the gate line control signal goes to a high level, the gate line driver 30 will stop the application of the above-described voltage and, consequently, the gate line voltage $V_{gate}$ will be reduced at a certain gradient to ground level. As a result, the TFT 24 is turned off but held in the state where a differential potential has been produced between the electrodes 22 and 20 because of the capacitor of the liquid crystal 18, and also the liquid crystal 18 is held in the state where the above-described light transmittance has been changed. Since the gate line driver 30 switches the gate line 28 to which a voltage is to be applied, each time the gate line control signal goes to a high level, and the application of the voltage and the stop of the application are performed at the above-described timing, a row of display cells to which the data line voltage $V_{data}$ is applied through the data line 32 is switched in sequence each cycle of the horizontal synchronous signal, and an image is to be displayed on the LCD 10.

Incidentally, the LCD 40 can be connected to various kinds of information processing systems as the system 44, but the frequencies (number of pulses of the dot clock signal in one cycle of the horizontal synchronous signals) and the signal conditions such as the length of one cycle of the horizontal or vertical synchronous signal are different, depending upon the kind of information processing system as the system 44. The gate-timing control circuit 50 determines the incoming of the on-timing and the off-timing by counting the number of pulses of the dot clock signal based on the horizontal synchronous signal, so the on-timing and the off-timing are be to skewed by a change in the above-described signal conditions.

Figure 7:
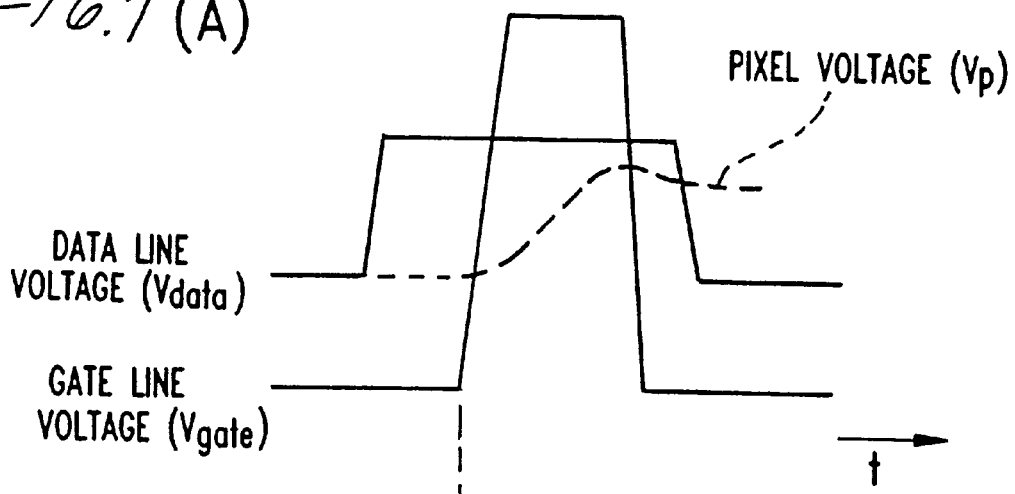
FIG. 7A is a timing chart showing the data line voltage, the gate line voltage, and a pixel voltage as the period in which the gate line voltage is applied to the gate line is short.
FIG. 7B is a timing chart showing the data line voltage, the gate line voltage, and the pixel voltage as the gate timing was corrected.
Figure 7:
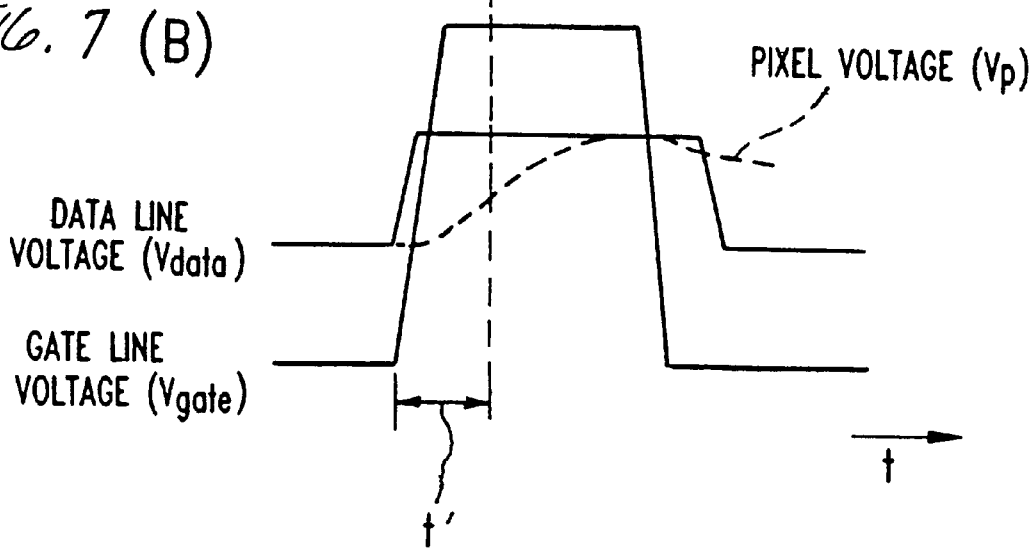

For example, in a case where the LCD 10 has the property that a voltage (hereinafter referred to as a pixel potential $V_p$) between the electrodes 22 and 20 increases relatively gradually from the time the TFTs 24 are turned on, or where the frequency of the dot clock signal became high, if the period during which the gate line voltage $V_{gate}$ is applied to the gate line 28 is short as shown in FIG. 7(A), the application of the gate line voltage $V_{gate}$ to the gate line 28 will be stopped before the pixel potential $V_p$ rises up the data line voltage $V_{data}$. As a result, since the pixel voltage $V_P$ does not reach the data line voltage $V_{data}$, there occurs a reduction in picture quality such as a reduction in the contrast of the displayed image.

In such a case, the value of the data N or M that the system 44 sets by the signal J1 or J2, for example, may be made larger (for this reason, $t_{ON}$ shown in FIG. 5 becomes short) so that the period during which the gate line voltage $V_{gate}$ is applied to the gate line 28 becomes longer. For this reason, for example when the value of the data N is made large, the timing that the gate line control signal goes to a logic low level, i.e., the timing (on-timing of TFT 24) that the gate line voltage $V_{gate}$ is applied to the gate line 28 become earlier as shown in FIG. 7(B), and the period in which the gate line voltage $V_{gate}$ is applied to the gate line 28 becomes long. Therefore, the pixel potential $V_p$ reaches the data line voltage $V_{data}$ and a reduction in the picture quality such as a reduction in contrast is eliminated.

When the capacitor of the gate line 28 of the LCD 10 is relatively large, the rise of the gate line voltage $V_{gate}$ becomes slowly, as the position on the gate line 28 is away from the gate line driver 30. Therefore, the timing that the TFT 24 is turned on becomes late and, as is the above-described case, there occurs a case in which part of the pixel potential $V_p$ does not reach the data line voltage $V_{data}$. In this case, as in the above case, the value of the data N or M may be made larger at the system 44 so that the period in which the gate line voltage $V_{gate}$ is applied to the gate line 28 become longer.

Figure 8:
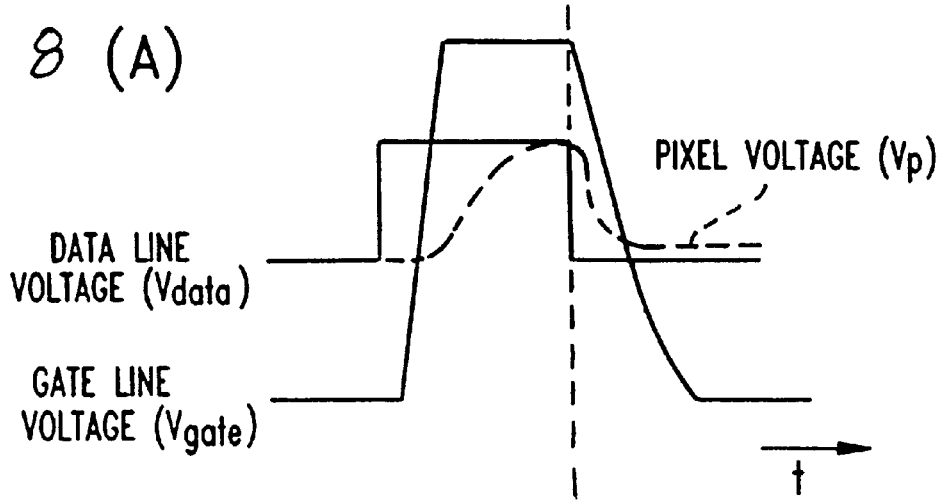
FIG. 8A is a timing chart showing the data line voltage, the gate line voltage, and the pixel voltage as the drop of the gate line voltage is late with respect to the stop of application of the data line voltage.
FIG. 8B is a timing chart showing the data line voltage, the gate line voltage, and the pixel voltage as the gate timing was corrected.
Figure 8:
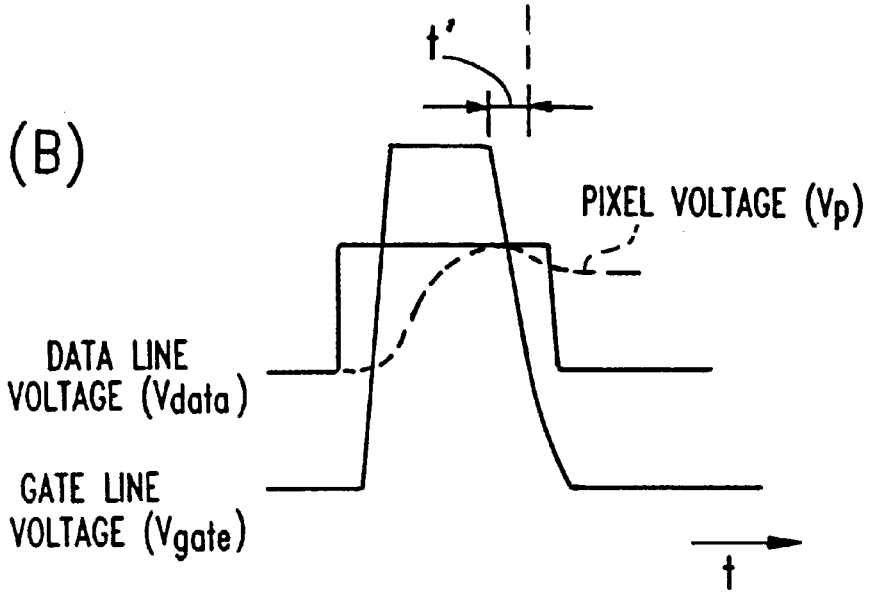

Also, when the capacitor of the gate line 28 of the LCD 10 is relatively large, since the rise of the gate line voltage $V_{gate}$ also becomes slow, there are some cases where, particularly at a position away from the gate driver 30, the ON state of the TFT 24 continues even after the application of the data line voltage $V_{data}$ to the data line 32 is stopped, and the pixel potential $V_p$ is reduced as shown in FIG. 8(A). This is visually recognized as a partial reduction in picture quality. In such a case, the value of the data M that may be set at the side of the system 44 by the signal J2 is made smaller (therefore, $t_M$ shown in FIG. 5 becomes longer) so that the timing (off-timing) that the application of the gate line voltage $V_{gate}$ to the gate line 28 is stopped becomes earlier.

Therefore, since the timing in which the gate line control signal goes to a logic high level, i.e., the timing that the application of the gate line voltage $V_{gate}$ to the gate line 28 is stopped becomes earlier as shown in FIG. 8(B), and the application of the gate line voltage $V_{gate}$ to gate line 28 is stopped before the application of the data line voltage $V_{data}$ to the data line 32 is stopped, there can thus be prevented an occurrence of a partial reduction in picture quality resulting from a reduction in the pixel potential $V_p$.

Figure 9:
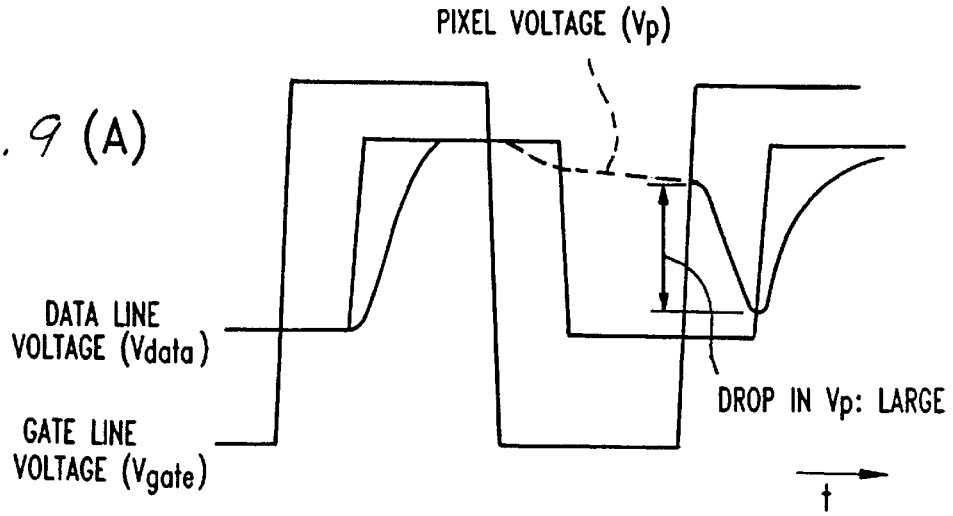
FIG. 9A is a timing chart showing the data line voltage, the gate line voltage, and the pixel voltage as, in the double scan drive, the rise of the data line voltage is late with respect to the rise of the gate line voltage.
FIG. 9B is a timing chart showing the data line voltage, the gate line voltage, and the pixel voltage as the gate timing is corrected.
Figure 9:
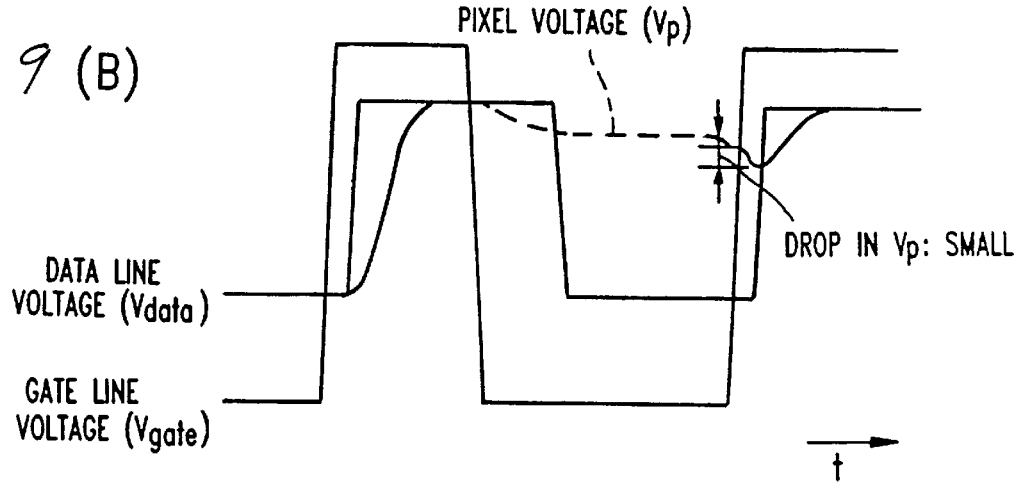

Also, as one of methods for driving the LCD, there is a so-called double scan method in which respective data line voltages $V_{data}$ are applied to the same cell row with two consecutive cycles of a horizontal synchronous signal. When, in this method, the rise of the data line voltage $V_{data}$ is late with respect to the rise of the gate line voltage $V_{gate}$, there are some cases in which the picture quality of a displayed image becomes unstable, because the gate line voltage $V_{gate}$ has been applied to the gate line 28 at the second cycle and also the pixel potential $V_p$ largely drops before the data line voltage $V_{data}$ is applied to the data line 32, as shown in FIG. 9(A).

In such a case, in order to make the above-described period short, the value of the data N that is set at the side of the system 44 by the control signal J1 may be made small so that the timing (on-timing) in which the gate line voltage $V_{gate}$ is applied to the gate line 28 becomes late. For this reason, since the timing in which the gate line control line signal goes to a logic low level, i.e., the timing in which the gate line voltage $V_{gate}$ is applied to the gate line 28 becomes late for each cycle, as shown in FIG. 9(B), the gate line voltage $V_{gate}$ is applied to the gate line 28, and the period in which the data line voltage $V_{data}$ is not applied to the data line 32 becomes short, a reduction in the pixel potential becomes small and the picture quality of a displayed image can be stabilized.

Thus, in the first embodiment, N and M are specified at all times in each cycle of the vertical synchronous signal by the signals J1 and J2, the incoming of the on-timing and off-timing of the gate line 28 is determined by counting the number of pulses of the dot clock signal based on the count number $N_o$ corresponding to the specified N and the count number $M_o$ corresponding to the specified M, and the application and stopping of application of the gate line voltage $V_{gate}$ to the gate line 28 are performed at the determined timing. Therefore, an image can be displayed on an LCD with a constant picture quality, independent of the magnitude of the capacitor of the liquid crystal 18 changing according to the space between the electrodes of the LCD 10, a variation in various characteristics of the LCD 10 such as the magnitude of the capacitor of the gate line 28, and the signal conditions of various signals that are output for displaying an image on the LCD 10 by the system 44.

Also, since in this embodiment the on-timing and off-timing can set arbitrarily, it becomes possible to employ, for example, the drive circuit 42 as a common drive circuit of various kinds of LCDs different in specification, and the P/4 cost of the LCD unit 40 can also be reduced. In such a case, depending on the characteristics of LCDs different in specification, the default values N' and M' which are set by the default set circuit or the data N and M which are set by the system 44 may be changed. With this, the LCD unit 40 capable of displaying an image with a constant picture quality can be obtained independent of the specification of the LCD 10.

The default values N' and M' may be changed according to the specification of the LCD 10 that is connected as described above. Further, in a case where, for example in the inspection process of the LCD, an occurrence of phenomena such as those shown in FIGS. 7 to 9 was found as a cause of various characteristic variations of each individual LCD 10 resulting from the production error of the LCD, it is preferable to adjust the default values N' and M' of the drive circuit 42 that is connected to that LCD 10. With this, the picture quality displayed on the LCD 10 can be made substantially constant independent of the various characteristic variations of the LCD 10.

Also, while in the above-described embodiment the N and M have been set in each cycle of the vertical synchronous signal by the system 44, the invention is not limited to this. The signals J1, J2, and J3 are output only when N and M are newly set at the side of the system 44 or the values of N and M are changed, the values of N and M specified by inputting the signals J1, J2, and J3 to the gate-timing control circuit 50, or the count numbers $N_o$ and $M_o$ corresponding to the specified N and M are stored in a storage means such as registers during the period in which next signals J1, J2, and J3 are input, the gate line control signal (YOE) is generated based on the values of N and M or the count numbers $N_o$ and $M_o$ corresponding to N and M which have been stored in the storage means, and, if signals J1, J2, and J3 are input, the data stored in the storage means may be updated according to the specifications by those signals.

Figure 10:
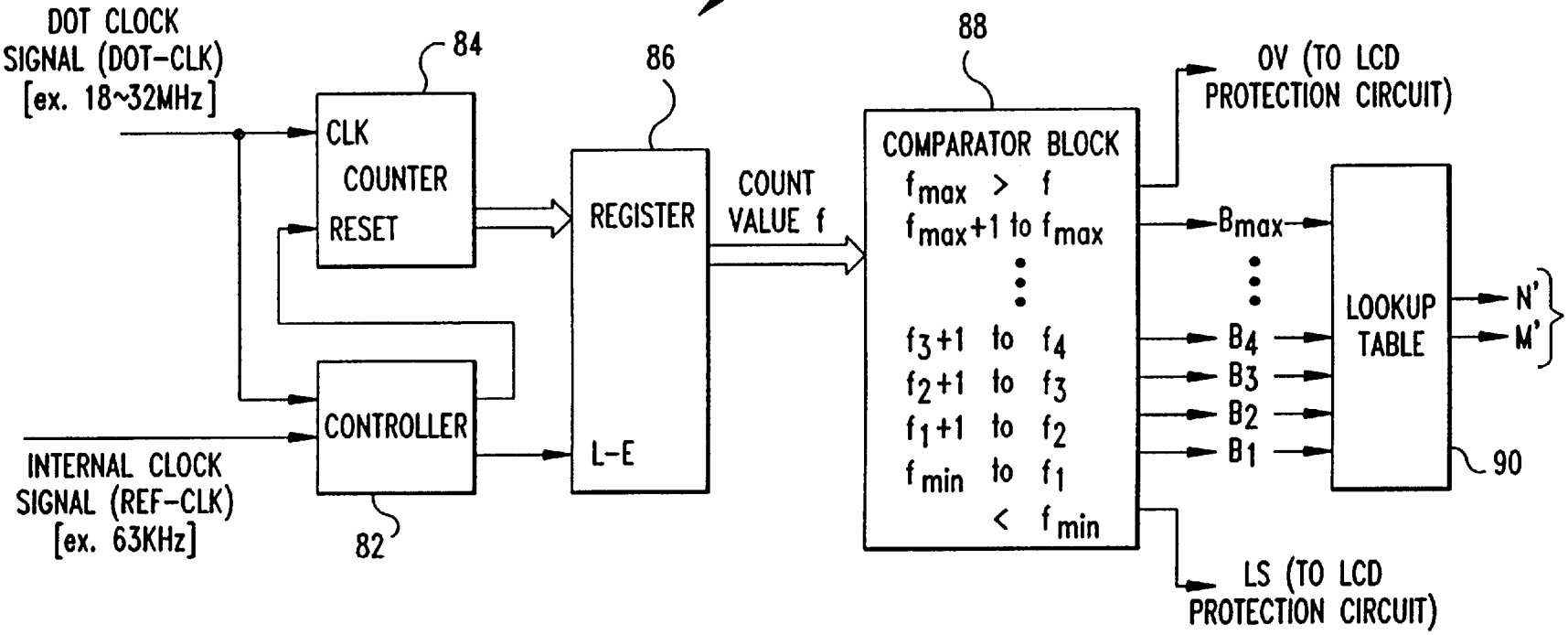
FIG. 10 is a block diagram shown an automatic gate-timing set circuit of a second embodiment of the present invention.

A second embodiment of the present invention will next be described. The same reference numerals will be applied to the same parts as the first embodiment, so a description of the same parts will be omitted here. In this second embodiment, three signal lines for transmitting signals J1, J2, and J3 from a system 44 to a gate-timing control signal 50 are omitted and, in a gate drive control circuit 48, there is provided a automatic gate-timing set circuit 80, as shown in FIG. 10.

Figure 11:
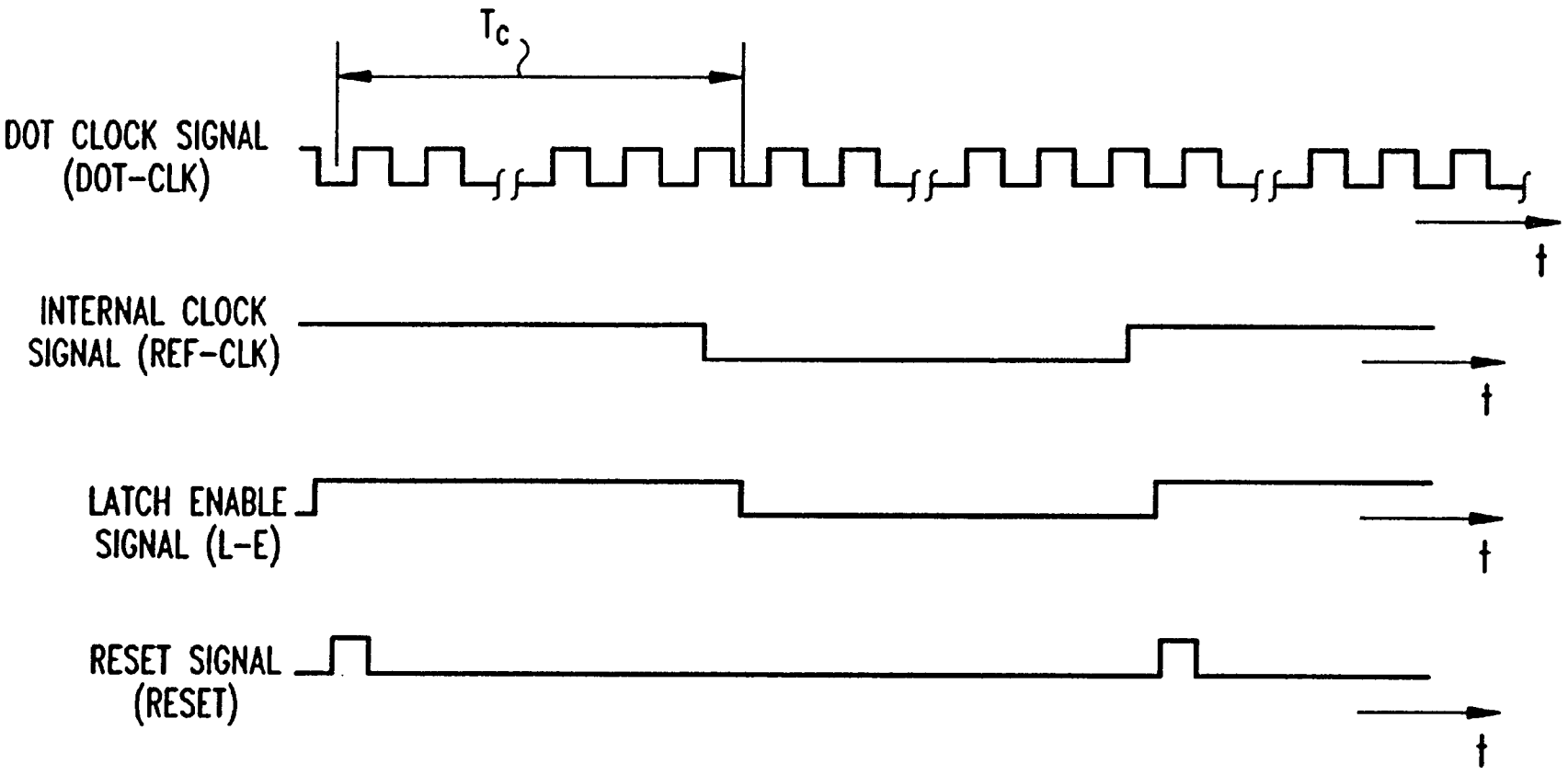
FIG. 11 is a timing chart showing the dot clock signal, the internal clock signal, the latch enable signal, and the reset signal of the second embodiment.

The automatic gate-timing set circuit 80 is provided with a controller 82. A dot clock signal and an internal clock signal (REF-CLK) of a constant frequency (for example 63 kHz) are input to the controller 82. The output terminals of the controller 82 are connected to the reset signal input terminal of a counter 84 and to the control signal input terminal of a register 86, and the controller 82 outputs a reset signal and a latch enable signal (L-E), to the counter 84 and the register 86, respectively. As shown in FIG. 11, if the internal clock signal goes to a logic high level, the controller 82 will make the latch enable signal high and output a pulse as a reset signal, during the time the dot clock signal is a logic low level. Also, if the internal clock signal goes to a logic low level, the controller 82 will make the latch enable signal low during the time the dot clock signal is a logic low level.

A dot clock signal is input to the clock signal input terminal of a counter 84. The counter 84 counts the number of pulses of the dot clock signal and, if the reset signal is input from the controller 82, will reset a count value. The data output terminal of the register 86 is connected to the data input terminal of a register 86. If the latch enable signal that is input from the controller 82 changes from a logic high level to a logic low level, the register 86 fetches the count value of the counter 84. From the foregoing, the number of pulses of the dot clock signal during a period (Tc of FIG. 11) corresponding to a half cycle of the internal clock signal is stored in the register 86. Note that the controller 82, the counter 84, and the register 86 correspond to the detection means of the present invention.

The data output terminal of the register 86 is connected to the data input terminal of a comparator block 88, and the data fetched in the register 86 is output as a count value f to the comparator block 88. The comparator block 88 compares the input count value f with each of a predetermined plurality of data $f_{min}$, $f_1$, $f_2$, . . . , and $f_{max}$, and determines whether the count value f belongs to any of the ranges of $f_{min}$ to $f_1$, $f_1$+1 to $f_2$, $f_2$+1 to $f_3$, . . . , and $f_{max-1}$+1 to $f_{max}$.

Note that $f_{min}$ corresponds to the count value because the frequency of the dot clock signal is 18 MHz and $f_{max}$ corresponds to the count value because the frequency of the dot clock signal is 32 MHz. Also, each of $f_1$, $f_2$, . . . , and $f_{max-1}$ corresponds to a boundary between two adjacent frequency ranges which are obtained by dividing a frequency range of 18 MHz and 32 MHz by a predetermined frequency and represents a count value that is obtained by the counter 84, when the frequency of the dot clock signal is its corresponding boundary frequency.

The output terminals of the comparator 88 are connected to the data input terminals of a lookup table 90. The comparator 88 and the lookup table 90 correspond to the second storage means and specification means of the present invention. If the comparator block 88 determines whether the count value input thereto belongs to any of the above-described ranges, the block 88 will output data indicative of a numerical value range to which the count value belongs (any of $B_1$ to $B_{max}$ corresponding to the numerical value ranges), to the lookup table. In the lookup table 90, each of $B_1$ to $B_{max}$ and the data N', M' described in the first embodiment are stored in the correspondence relationship. The data items N and M represent the optimum on-timing and off-timing as because the frequency of the dot clock signal is a value within the above-described frequency range, and are preset based on experiments, while the quality of the image displayed on the LCD 10 is being checked.

If data is input to the lookup table 90 by the comparator block 88, the lookup table 90 will output data N and M corresponding to the input data to the gate-timing control circuit 50. Since, based on the input data N and M, the gate-timing control circuit 50 generates a gate line control signal in the same way as in the first embodiment, a gate line 28 is to be driven at an optimum timing corresponding to the frequency of the dot clock signal. Therefore, even in a case in which, for example, the system 44 changes the frequency of the dot clock signal or the frequency of the dot clock signal is changed by changing the system 44 that is connected to the LCD unit 40, this frequency change is detected by the automatic gate-timing set circuit 80 and gate timing is changed to the optimum timing corresponding to the changed frequency.

When the comparator 88 determines that the count value f is smaller (LS shown in FIG. 10) than $f_{min}$ or greater (OV shown in FIG. 10) than $f_{max}$, it outputs a signal to an LCD protection circuit (not shown) because the frequency of the dot clock signal is not within a range of 18 MHz and 32 MHz. To protect the LCD 10, the LCD protection circuit makes the LCD 10 display a black raster image (the entire surface is a black image) by the use of an internal clock signal.

In this second embodiment, signal lines for transmitting the signals J1, J2, and J3 become unnecessary and it is not necessary to provide in the system 44 circuits for generating and outputting the signals J1, J2, and J3. Therefore, a presently existing information processing system can be used as the system 44 without any change.

While, in the foregoing, the value N indicative of time $t_{ON}$ with the number of the pulses of the dot clock signal and the value M indicative of time $t_M$ (which corresponds to a result obtained by subtracting $t_{OFF}$ from the cycle $T_H$ of the horizontal synchronous signal) with the number of the pulses of the dot clock signal have been specified, and the time $t_{ON}$ and the time$_{OFF}$ have been determined based on the specified N and M, the present invention is not limited to this, but the value of $t_{ON}$, $t_{OFF}$ or the value of $t_M$ may be specified as is. In the above-described embodiment, three signal lines are needed for specifying the on-timing and the off-timing, but when the value of $t_{ON}$, $t_{OFF}$ or the value of $t_M$ itself is specified as described above, the number of signal lines equal to the number of bits of each data is needed. Therefore, it is preferable that the values N and M expressed with the number of pulses of the dot clock signal be specified, as described above.

While the time $t_M$ (more particularly, a value M indicative of time $t_M$ with the number of pulses of the dot clocks) that time $t_{OFF}$ (time between the time that the horizontal synchronous rises and the time that the gate line is turned off) is subtracted from the cycle $T_H$ of the horizontal synchronous signal has been specified as the off-timing of the gate line, the present invention is not limited to this. Data indicative of time $t_{ON}$ or time $t_{OFF}$ with the number of pulses of the dot clock signal may be specified. However, the applicant of this application has found that, when time $t_{OFF}$ be specified, the number of gates of the gate-timing control circuit is increased as compared with the gate-timing control circuit 50 described in this embodiment. It is therefore preferable that the data indicative of the time $t_M$ that time $t_{OFF}$ be subtracted from the cycle $T_H$, or $t_M$ with the number of pulses of the dot clock signal be specified as the off-timing of the gate line.

While, in the above-described embodiment, a TFT active-matrix driven LCD 10 has been used as an LCD, the present invention is not limited to this. For example, the invention is applicable to various kinds of active-matrix-driven LCDs.

As described above, when at least either on-timing at which the switching element is turned on or off-timing at which the switching element is turned off is specified information representative of the specified at least either on-timing or off-timing is held. The switching element is turned on at predetermined timing according to information indicative of at least either latest on-timing or off-timing stored in the holding means, after a voltage has been applied to the liquid crystal through the transparent electrode pair, the switching element is turned off at the predetermined timing, and it is repeated, at intervals of a predetermined cycle. Therefore, the invention has an excellent advantage that, independent of the various characteristic variations of the liquid crystal display and the conditions of signals for displaying an image on a liquid crystal display, it becomes possible to display an image on a liquid crystal display with a constant picture quality.

An incoming of at least either the on-timing or the off-timing that the latest information held in the holding means represents is decided by counting the number of pulses of a clock signal as a reference of the predetermined cycle. Therefore, the invention has an excellent advantage in that the incoming of on-timing and off-timing can be accurately decided.

Plural kinds of data which represent plural kinds of timings different from each other as the on-timing and off-timing of the switching element with the number of pulses of the clock signal are prestored, and if information for selecting any of the plural kinds of data prestored in the first storage means is input and then the at least either on-timing or off-timing is specified, any of the plural data is selected according to the input information and is held. Therefore, in addition to the above-described advantage, the invention has an excellent advantage in that an amount of information for indicating at least either on-timing or off-timing can be reduced.

Each of the plural kinds of data, which represents with the number of pulses of the clock signal at least either suitable on-timing or off-timing of the switching element that changes according to the frequency of the clock signal is prestored in correspondence with the frequency of the clock signal. The frequency of the clock signal is detected, and data corresponding to the frequency of the clock signal detected by the detection means is selected from the plural kinds of stored data. The at least either on-timing or off-timing is specified by the selected data. Therefore, in addition to the above-described advantage, the invention has an excellent advantage in that an appropriate change of at least either on-timing or off-timing can be automatically performed according to a change in the frequency of the clock signal without depending upon additional external equipment.

We claim:

1. A drive unit of a liquid crystal display for driving a liquid crystal display that has a switching element, a transparent electrode pair spaced a predetermined distance apart, and liquid crystal interposed between the transparent electrodes, comprising:

a holding means for holding and storing, when at least either on-timing at which said switching element is turned on or off-timing at which said switching element is turned off is specified within a predetermined cycle, information data representative of the specified at least either on-timing or off-timing at a particular dot clock signal frequency, including means having prestored therein a plurality of data which represent a plurality of on-off timings, different from each other, on the on-timing and off timing of each switching element for different counted numbers of pulses of the dot clock signal; and a drive means for turning on said switching element at a predetermined timing according to information indicative of at least either latest on-timing or off-timing stored in said holding means, repeating at intervals of a predetermined cycle that said switching element is turned off at said predetermined timing, after a voltage has been applied to said liquid crystal through said transparent electrode pair, and driving said liquid crystal display, wherein the drive means includes a counter means for counting pulses of the dot clock signal, wherein the pulse timing of a horizontal synchronous signal is used as a reference to restart counting of the pulses of the dot clock signal by the counter means, and the drive means selects the on-off timing from the plurality of prestored data for the particular number of counted pulses of the dot clock signal by the counter means.

2. The drive unit of liquid crystal display as set forth in claim 1, wherein said driving means is provided with a decision means for deciding an incoming of at least either said on-timing or said off-timing that latest information held in said holding means represents, by counting the number of pulses of a clock signal as a reference of said predetermined cycle, and said switching element is turned on and off when said incoming of at least either said on-timing or said off-timing is decided by said decision means.

3. The drive unit of liquid crystal display as set forth in claim 2, which further comprises:

a first storage means having prestored therein plural kinds of data which represent plural kinds of timings different from each other as the on-timing and off-timing with said number of pulses of said clock signal, and wherein, if information for selecting any of said plural kinds of data prestored in said first storage means is input and then said at least either on-timing or off-timing is specified, said holding means selects any of said plural data according to said input information and holds said selected data as information representative of the specified at least either on-timing or off-timing, and wherein said decision means decides the incoming of said specified timing by counting said number of pulses of said clock signal according to the latest data held in said holding means.

4. The drive unit of liquid crystal display as set forth in claim 2, which further comprises:

a second storage means in which each of said plural kinds data, which represents with the said number of pulses of the clock signal at least either suitable on-timing or off-timing of said switching element that changes according to the frequency of said clock signal, is prestored in correspondence with said frequency of said clock signal;

a detection means for detecting said frequency of said clock signal; and a specification means for selecting data corresponding to the frequency of the clock signal detected by said detection means from said plural kinds of data stored in said second storage means and specifying said at least either on-timing or off-timing by the selected data.

5. A drive method of driving a liquid crystal display that has a switching element, a transparent electrode pair spaced a predetermined distance apart, and liquid crystal interposed between the transparent electrodes, comprising the steps of:

when at least either on-timing at which said switching element is turned on or off-timing at which said switching element is turned off is specified within a predetermined cycle, holding and storing information data representative of the specified at least either on-timing or off-timing at a particular dot clock signal frequency, including prestoring a plurality of data which represent a plurality of different on-off timings, different from each other, on the on-timing and off-timing of each switching element for different counted numbers of pulses of the dot clock signal; and turning on said switching element at a predetermined timing according to information indicative of at least either latest on-timing or off-timing stored information data, repeating at intervals of a predetermined cycle that said switching element is turned off at said predetermined timing, after a voltage has been applied to said liquid crystal through said transparent electrode pair, and driving said liquid crystal display, including counting the pulses of the dot clock signal, wherein the pulse timing of a horizontal synchronous signal is used as a reference to restart counting of the pulses of the dot clock signal, and selecting the on-off timing from the prestored plurality of data for the particular number of counted pulses of the dot clock signal.

6. The drive unit of liquid crystal display as set forth in claim 5, wherein an incoming of at least either said on-timing or said off-timing that latest information held in said holding means represents is decided by counting the number of pulses of a clock signal as a reference of said predetermined cycle, and said switching element is turned on and off when said incoming of at least either said on-timing or said off-timing is decided.

7. The drive unit of liquid crystal display as set forth in claim 6, which further comprises the steps of:

prestoring plural kinds of data which represent plural kinds of timings different from each other as the on-timing and off-timing of said switching element with said number of pulses of said clock signal;

if information for selecting any of said plural kinds of data prestored in said first storage means is input and then said at least either on-timing or off-timing is specified, selecting any of said plural data according to said input information and holding said selected data as information representative of the specified at least either on-timing or off-timing; and deciding the incoming of said specified timing by counting said number of pulses of said clock signal according to the latest data held in said holding means.

8. The drive unit of liquid crystal display as set forth in claim 6, which further comprises the steps of:

prestoring each of said plural kinds data, which represents with the said number of pulses of the clock signal at least either suitable on-timing or off-timing of said switching element that changes according to the frequency of said clock signal, in correspondence with said frequency of said clock signal;

detecting said frequency of said clock signal; and selecting data corresponding to the frequency of the clock signal detected by said detection means from said plural kinds of data stored in said second storage means, and specifying said at least either on-timing or off-timing by the selected data.

* * * * *